United States Patent [19]

Roberts, Jr.

[11] 3,982,285

[45] Sept. 28, 1976

[54] COMBINED GRAB BAR AND SHOWER HEAD FIXTURE

[76] Inventor: R. Douglas Roberts, Jr., 845 Forest Hills Drive, Nashville, Tenn. 37220

[22] Filed: July 17, 1975

[21] Appl. No.: 596,834

[52] U.S. Cl. ..... 4/145
[51] Int. Cl.² ..... B05B 15/06
[58] Field of Search ..... 4/145, 146

[56] References Cited

UNITED STATES PATENTS

| | | | |
|---|---|---|---|
| 3,564,621 | 2/1971 | Fletcher | 4/145 |
| 3,724,760 | 4/1973 | Smith | 4/145 |
| 3,822,826 | 7/1974 | Wilson | 4/145 |

*Primary Examiner*—Robert I. Smith
*Attorney, Agent, or Firm*—Steinberg and Blake

[57] ABSTRACT

An assembly which is designed to function both as a grab bar and as a shower head fixture. A grab bar structure which is adapted to be fixed to a wall has opposed end regions at least one of which has a hollow interior space while a shower head which is to be used for providing a shower spray also has a hollow interior space. A mounting structure mounts the shower head on the grab bar structure with the hollow interior space of the shower head communicating with the hollow interior space at the above end region of the grab bar structure so that in this way the combined assembly forms a combination grab bar and shower head fixture.

9 Claims, 5 Drawing Figures

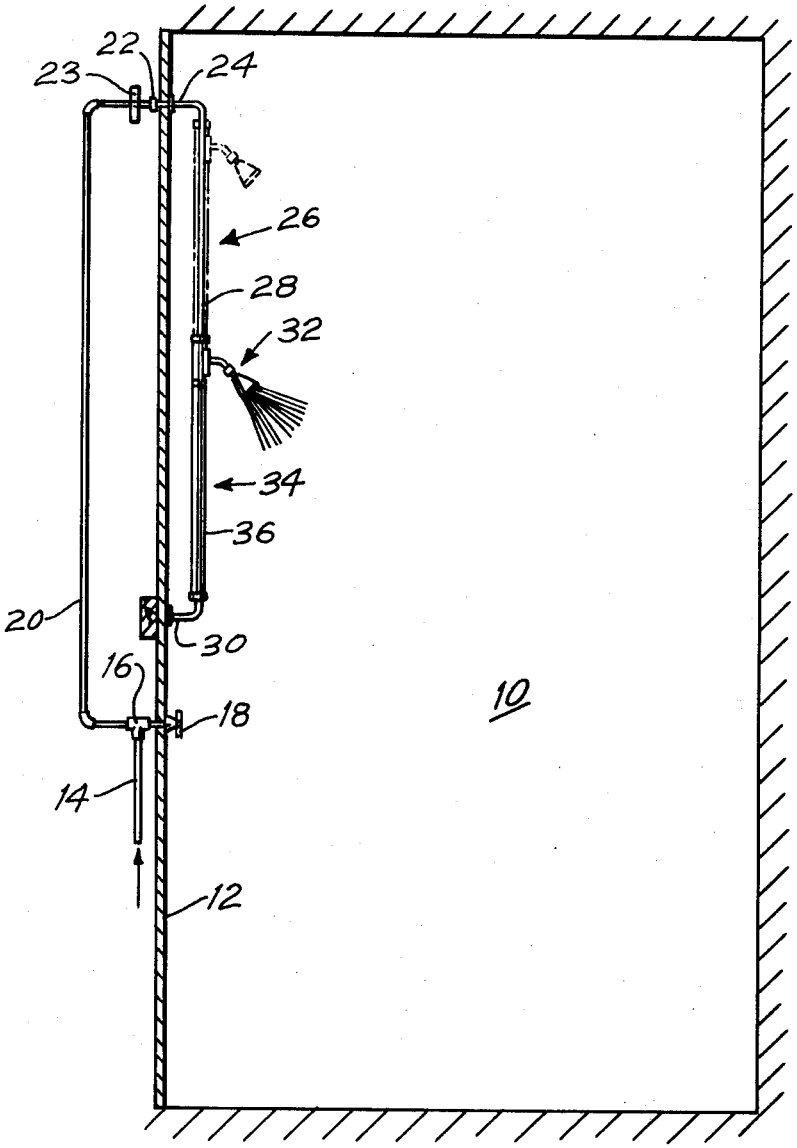
FIG.1
FIG.4
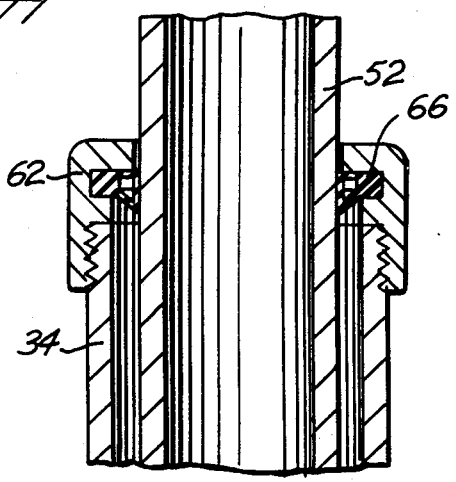
FIG.3
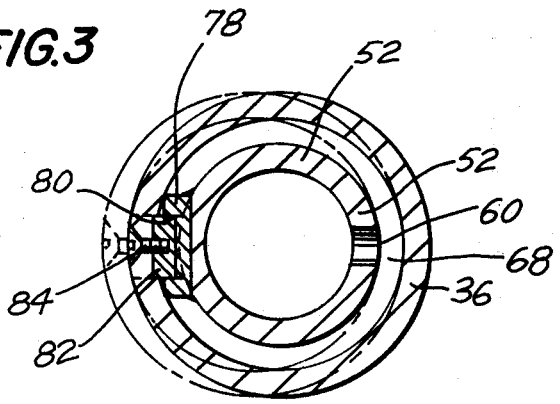

COMBINED GRAB BAR AND SHOWER HEAD FIXTURE

BACKGROUND OF THE INVENTION

The present invention relates to fixtures intended for use in connection with showers.

Such fixtures conventionally include units forming a shower head as well as units forming a grab bar. The grab bar and shower head fixtures are separate structures which are separately mounted. As a result it is necessary to provide separate locations for these separate fixtures and to carry out separate mounting procedures in connection therewith. In addition, when an individual takes a shower it is necessary for such an individual on the one hand to remember where the grab bar is in order to make use thereof when necessary while on the other hand it is necessary for the individual to have acess to a completely different location when adjustment of the shower head is required, for example.

Thus, the costs involved with such separate fixtures and the installation thereof are undesirably high and at the same time the use of the separate fixtures represents a certain inconvenience.

SUMMARY OF THE INVENTION

It is accordingly a primary object of the present invention to provide a structure which will avoid the above drawbacks involved in connection with separate grab bar and shower head fixtures.

Thus, it is an object of the present invention to provide a single assembly which can function on the one hand as a grab bar and on the other hand as a shower head.

A further object of the present invention is to provide a structure which makes it possible to adjust the position of the shower head with a single assembly of the above type.

It is particularly an object of the present invention to provide a single assembly of the above type which renders the possibility of adjusting the elevation of the shower head exceedingly convenient to carry out while at the same time maintaining the advantages of a grab bar at a convenient location.

Furthermore it is an object of the present invention to provide an assembly of the above type which is made up of components which can be simply and quickly assembled and disassembled.

Moreover, it is an object of the present invention to provide a structure of the above type which is composed of relatively simple, rugged, reliably operating elements which can be produced and installed at relatively low cost and which at the same time enable considerable advantages to be achieved when compared with separate shower head and grab bar fixtures.

According to the invention the assembly includes a grab bar means having opposed end regions and an elongated intermediate region extending between these end regions. A pair of fixing means are operatively connected with the end regions for fixing the latter to a wall with the intermediate region spaced the wall so as to be accessible to an individual taking a shower. A shower head means is provided for providing a shower spray. This shower head means has a hollow interior space and at least one of the above end regions of the grab bar means also has a hollow interior space. A mounting means is provided for mounting the shower head means on the grab bar means with the hollow interior space of the shower head means communicating with the hollow interior space of the above end region of the grab bar means. This latter hollow interior space of the grab bar means communicates with a supply of water, so that through this interior space of the grab bar means and the interior space of the shower head means the water spray is provided by way of the shower head means.

BRIEF DESCRIPTION OF DRAWINGS

The invention is illustrated by way of example in the accompanying drawings which form part of this application and in which:

FIG. 1 is a schematic illustration of the manner in which the structure of the invention is situated in a compartment where an individual takes a shower;

FIG. 3 is a sectional plan view taken along line 3—3 of FIG. 2 in the direction of the arrows and showing the structure of FIG. 2 at a somewhat enlarged scale with FIG. 3 also showing in dot-dash lines how the parts may be assembled and disassembled;

FIG. 4 is a fragmentary sectional elevation taken along line 4—4 of FIG. 2 in the direction of the arrows and also showing the structure at a scale which is somewhat enlarged as compared to FIG. 2, FIGS. 3 and 4 both illustrating how a sleeve cooperates with an intermediate region of the grab bar means.

DESCRIPTION OF A PREFERRED EMBODIMENT

Figure 2:
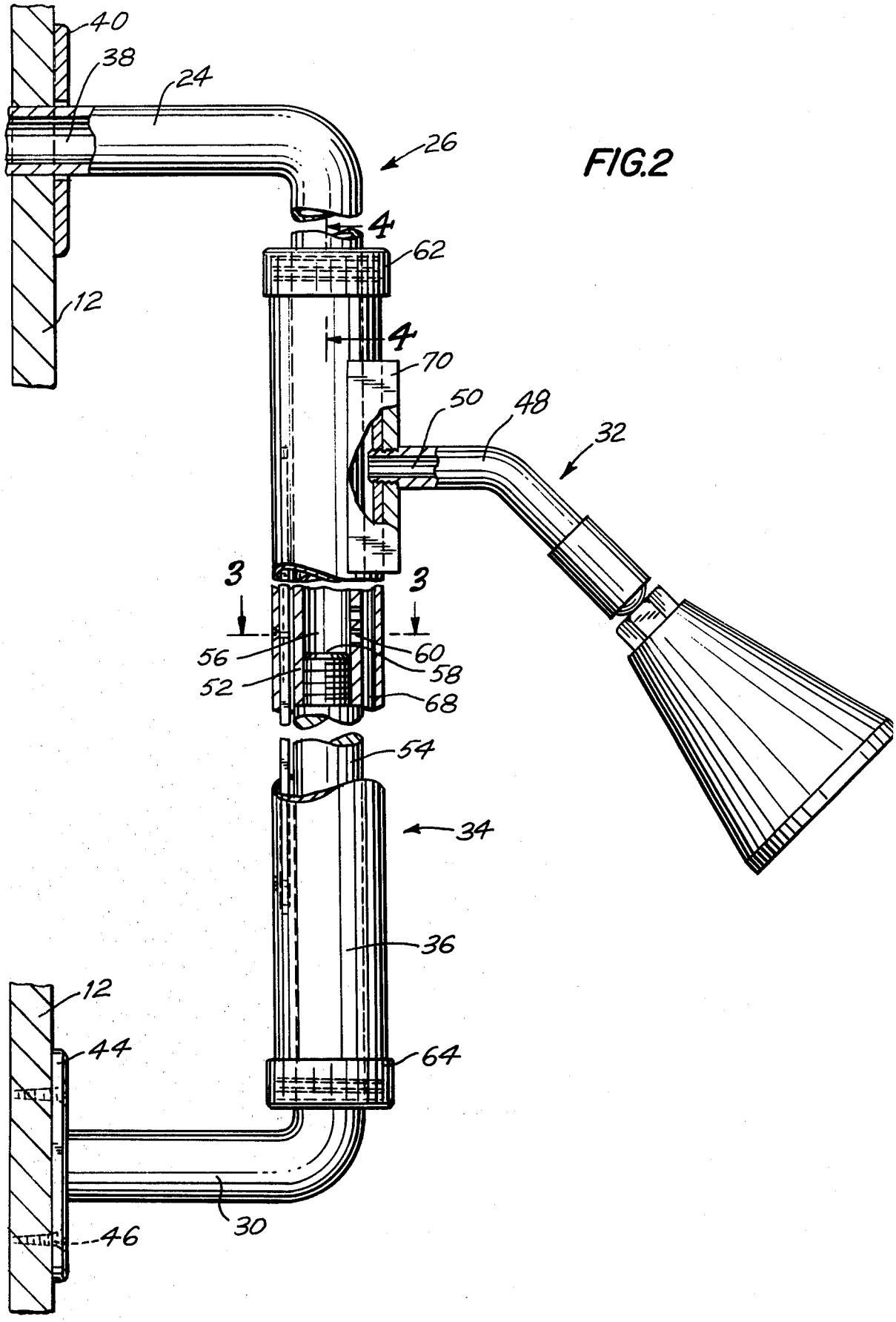
FIG. 2 is a fragmentary partly sectional illustration of one possible embodiment of a structure according to the present invention forming part of the structure which is schematically illustrated in FIG. 1.
Figure 5:
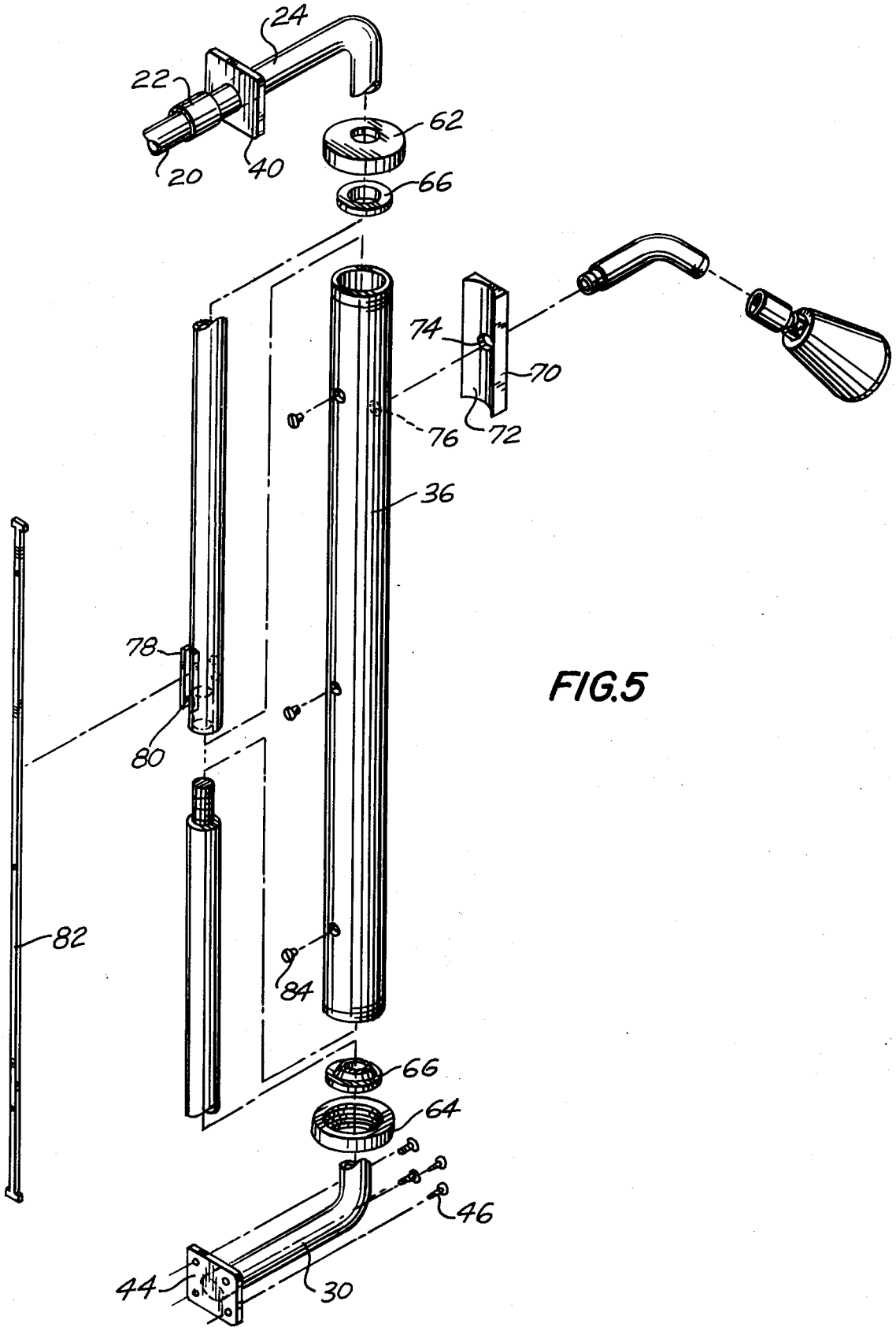
FIG. 5 is an exploded perspective partly fragmentary illustration of the various components which are assembled together to form a structure as shown in FIG. 2.

Referring to FIG. 1, there is schematically illustrated therein a shower compartment 10 defined in part by a wall 12 behind which is located a supply pipe 14 for water which is to be used in the shower. This supply pipe 14 communicates with a valve 16 capable of being adjusted by way of a handle 18 accessible to an individual in the shower compartment 10. Thus, by adjusting the handle 18 it is possible to regulate the valve 16 so as to turn the shower on and off and control the rate of flow of the water from the pipe 14 into a pipe 20 which is also situated behind the wall 12. Of course this structure is shown in a simplified manner since it forms no part of the present invention. Actually there may be a pair of adjusting handles 18 controlling valves for hot and cold water with the hot and cold water being suitably mixed before reaching the pipe 20 so as to control not only the rate of flow but also the temperature of the water.

The pipe 20 communicates at its upper end through a suitable fitting 22 with the hollow interior of an end region 24 of a grab bar means 26 which has an elongated intermediate region 28 extending from the upper end region 24. The intermediate region 28 of the grab bar means 26 is also connected to a lower end region 30 of the grab bar means 26.

A shower head means 32 is also shown schematically in FIG. 1. A mounting means 34 mounts the shower head means 32 on the grab bar means 26, this mounting means including a sleeve 36 which can be vertically displaced along the intermediate region 28 of the grab bar means 26 so that it is possible to change the elevation of the shower head means 32 as is apparent from a comparison of a solid and dot-dash line illustrations thereof in FIG. 1.

The above assembly of the grab bar means 26, the shower head means 32, and the mounting means 34 forms the single fixture of the invention, and the details thereof are illustrated in FIGS. 2–5. Thus, FIG. 2 shows in a partly sectional manner the upper end region 24 of the grab bar means 26, this upper end region 24 having a hollow interior space 38 which communicates with the interior of the part 20 so that the water is supplied to the fixture of the invention through the hollow interior space 38. The end region 24 is attached to the supply line 20 which is anchored to the supporting wall 12 behind the latter by way of strap anchor 23. Flange 40 is a standard escutcheon. In a similar manner the lower end region 30 of the grab bar means has fixed thereto a flange 44 which forms a fixing means for fixing the lower end region 30 to the wall 12. Thus suitable screws 46 extend through openings of the flange 44 for fixing the latter to the wall 12 in the manner shown at the lower portion of FIG. 2.

The shower head means 32 may be of a conventional construction and has an elongated tubular portion 48 providing the shower head means 32 with a hollow interior space 50. By way of the mounting means 34 the shower head means 32 is mounted on the grab bar means with the hollow interior space 50 communicating with the hollow interior space 38 so that the water will flow to the shower head means 32 in order to provide a spray as shown diagrammatically in FIG. 1.

The elongated straight intermediate region 28 of the grab bar means 26 is thus positioned with respect to the wall 12 so as to be situated in front of and spaced therefrom, thus affording an individual the capability of grasping this intermediate region 28 or the sleeve 36 surrounding the same so that the structure of the invention will afford all of the advantages of a conventional grab bar. A part of the intermediate region 28 forms a portion of the mounting means 34. For this purpose the intermediate region 28 of the grab bar means 26 is made in two sections 52 and 54 (FIG. 2) which are removably fixed to each other for a purpose referred to below, and the upper section 52 is fixed with the end region 24 while the lower section 54 is fixed with the end region 30. Thus upper section 52 of the intermediate region 28 is itself in the form of a hollow tube having a hollow interior space 56 which communicates with the hollow interior space 38. Thus, the end region 24 and the section 52 form a single continuous tubular structure of substantially L-shaped configuration. On the other hand, the section 54 may be solid and terminates in a threaded portion 58 of reduced diameter received in an interior thread of the section 52 in the manner shown in FIG. 2 so as to provide in this way the releasable connection between the sections 52 and 54, for a purpose referred to below.

Just above the section 54, at a location approximately midway between the opposed end regions 24 and 30, the wall of the tubular section 52 is formed with at least one opening 60 passing through this wall, a pair of these openings being indicated in FIG. 2. Thus, the water which reaches the interior space 38 will flow to the interior space 56 and from the latter out through the openings 60 for a purpose referred to below.

As was indicated above, the mounting means 34 includes not only a portion of the intermediate region 28 which has the hollow interior space 56, but also an outer sleeve 36. This outer sleeve 36 freely surrounds the intermediate portion 28 of the grab bar means 26. This sleeve 36 has opposed and lower ends 62 and 64, respectively. These ends 62 and 64 of the sleeve 36 may be in the form of cap members capable of being threaded onto the ends of the sleeve 36. As is apparent from FIG. 4, the end 62 of the sleeve 34 is threaded onto the latter and is formed in its interior with a groove which receives a sealing ring 66. This sealing ring 66 is hollow and of the type which will increase its frictional engagement with the exterior surface of the section 52 in response to the pressure of water on the tapered lower surface of the ring 66, as viewed in FIG. 4. The end 64 is identical with the end 62 and connected in the same way to the lower end of the sleeve 36 and carries in the same way another sealing ring 66 indicated in FIG. 5. Thus, by way of its ends 62 and 64 together with the sealing rings 66 the sleeve 36 has at its opposed ends a sliding fluid-tight engagement with the exterior surface of the intermediate region of the grab bar means 26. The hollow interior space 68 of the sleeve 36 thus surrounds the intermediate region of the grab bar means 26, so that the water will flow from the openings 60 into the space 68 and will be retained in this space by way of the sealing rings 66. As is apparent from FIG. 1 in particular, the length of the sleeve 36 is approximately 1/2 the length the intermediate region 28 of the grab bar means 26, and in addition it will be noted that the openings 60 are situated approximately midway between the end regions 24 and 30. As a result, irrespective of the position of the sleeve 36 along the intermediate region 28, the openings 60 will at all times communicate with the space 68, so that the openings 60 will not be uncovered by the sleeve 36.

An upper region of the sleeve 36 is formed with a threaded opening which receives a threaded end of the tube 48 of the shower head means 32. Between a shoulder of the tube 48 and the sleeve 36 is located a suitable mounting plate 70 having a curved surface 72 which conforms to the curvature at the exterior of the sleeve 36. This mounting plate 70 has an outer flat surface engaged by the shoulder of the tubular portion 48 of the shower head means 32. In this way the shower head means 32 can be threadedly connected at the end of the tubular portion 48 through the opening 74 (FIG. 5) of the mounting plate 70 and the threaded opening 76 of the sleeve 36 to the sleeve 36 so that the interior space 50 communicates with the interior space 68. Therefore, when the valve 16 is opened the water will flow from the interior space 38 of end region 24 along the interior space 56 of the intermediate region 28 and through the opening 60 into the space 68 in order to flow from the latter into the tubular portion 48 at the interior space 50 thereof so as to issue from the shower head.

According to a further feature of the invention a guide means is provided to guide the sleeve 36 for movement longitudinally along the intermediate region 28 of the grag bar means 26 while preventing the sleeve 36 from turning around the intermediate region 28. For this purpose an outer surface portion of the section 52 of intermediate region 28 fixedly carries a keyway member 78 which extends longitudinally of the section 52 and which is formed with a groove 80 (FIG. 5) which extends parallel to the axis of the section 52. For example the keyway member 78 may simply be welded to the exterior surface of section 52, and the exterior surface of the later to which keyway member 78 is fixed may be flattened as shown most clearly in FIG. 3. The guide means includes in addition to the keyway member 78 an elongated key member 82 which is received in the groove 80 and which is fixed to an inner surface portion of the sleeve 36. As is apparent from FIG. 5 the key member 82 has a substantial length and terminates in a pair of opposed T-ends situated adjacent the ends of the sleeve 36. Suitable screws 84 which are countersunk into openings formed in the sleeve 36 extend through these openings into threaded openings of the key member 82 for the purpose of fixing the latter to the inner surface portion of the sleeve 36, and of course the connection of the key member 82 to the sleeve 36 by the screws 84 is fluid-tight so that water cannot leak out at the connection of the key member 82 to the sleeve 36. It will be noted that these T-shaped ends of the key member 82 can also cooperate with the ends of the keyway member 78 to limit the extent of movement of the sleeve 36 with respect to the intermediate region 28 of the grab bar means 26.

It is apparent, therefore, that with the above-described structure of the invention a simple fixture combining the features of a grab bar and shower head is provided. Not only is the intermediate region of the grab bar accessible to an individual to prevent the individual from falling, but in addition this intermediate region serves to position the shower head forwardly of the wall 12 in a manner providing an exceedingly comfortable shower arrangement. At the same time it is possible to shift the sleeve 36 along the intermediate portion of the grab bar means so as to adjust the elevation of the shower head.

Moreover, the assembly can be easily taken apart for any desired purpose such as for cleaning purposes, for replacing one or the other of the sealing rings 66, or for any other desired purpose. Thus, for this purpose it is only necessary to remove the screws 46 an to displace the flange 44 slightly forwardly from the wall 12. Of course, the valve 16 will be closed at this time. Then it is a simple matter to unscrew the lower section 54 from the upper section 52 of the intermediate region 28 of the grab bar means 26. With this lower section 54 thus separated from the upper section 52, the lower section can slipped out of the lower sealing ring 66. Now the lower end 64 of the sleeve 36 can be unscrewed in the event that it is desired to replace the lower sealing ring 66.

In order to carry out a further disassembly it is only necessary to remove the upper end 62 from the sleeve 36. With this upper end 62 thus separated from the remainder of the sleeve 36, the latter can be displaced rearwardly with respect to the section 52 in the manner shown in dot-dash lines in FIG. 3. The inner diameter of the sleeve 36 is greater than the outer diameter of the section 52 by an amount sufficient to enable the key member 82 to become displaced rearwardly beyond the keyway member 78, outwardly beyond the groove thereof, when the sleeve 36 is displaced rearwardly with respect to the section 52 in the manner shown in dot-dash lines in FIG. 3. With the sleeve 36 thus displaced to the dot-dash line position of FIG. 3, the entire sleeve can now be moved downwardly from the section 52 from which the section 54 has already been separated as described above.

In this way the entire assembly can be taken apart, and of course it can be reassembled through the reverse of the above operations.

By providing the guide means 78, 82, the sleeve 36 is prevented from turning around the intermediate region 28 of the grab bar means 26, so that if an individual should grasp the sleeve 36 a greater security is provided than if the sleeve 36 could turn freely around the intermediate region 28. Thus the sleeve 36 itself can form part of the grab bar structure.

The seals 66 hold the pipe in position under pressure of the water. The elevation of the shower head can be changed when the pressure is off.

It will be noted that by situating the shower head 32 at the region of the upper end of the sleeve 36 it is possible to locate the shower head at a relatively high elevation, as shown in dot-dash lines in FIG. 1. At the same time, the lower end of the sleeve 36 is not situated so high that it cannot be grasped by an individual of relatively short stature who desires to move the sleeve 36 down so as to locate the shower head at a lower elevation as shown in solid lines in FIG. 1.

It is thus apparent that by way of the present invention an exceedingly convenient combined grab bar and shower head fixture is provided which at the same time can be easily installed and maintained.

What is claimed is:

1. In a combined grab bar and shower assembly, grab bar means having opposed end regions and an intermediate elongated region extending between said opposed end regions, a pair of fixing means respectively connected operatively with said opposed end regions of said grab bar means for fixing said opposed end regions thereof to a wall with said intermediate region spaced from said wall so as to be accessible to an individual taking a shower, at least one of said end regions of said grab bar means having a hollow interior space which can be placed in communication with a supply of water to be used for shower purposes, shower head means for providing a shower spray, said shower head means also having a hollow interior space, and mounting means operatively connected with said grab bar means and with said shower head means for mounting the latter on said grab bar means with the hollow interior space of said shower head means communicating with the hollow interior space of said one end region of said grab bar means, whereby the assembly forms a combined grab bar and shower fixture, said mounting means including at least a portion of said intermediate region of said grab bar means which is formed with a hollow interior space communicating with said hollow interior space of said one end region of said grab bar means, and said hollow interior of said shower head means communicating with said hollow interior space of said one end region of said grab bar means through said hollow interior space of said intermediate region of said grab bar means, said mounting means further including a hollow sleeve surrounding and at least partly spaced from said portion of said intermediate region of said grab bar means, said sleeve having opposed ends fluid-tightly engaging said intermediate region of said grab bar means, and the portion of said intermediate region of said grab bar means which is formed with said hollow interior space communicating with said hollow interior space of said one end region of said grab bar means being formed at a wall thereof with at least one opening providing communication between the interior of said sleeve and the interior space of said portion of said intermediate region of said grab bar means, and said shower head means being carried by said sleeve and having its hollow interior space communicating with the interior of said sleeve so that water will flow through the hollow interior space of said one end region of said grab bar means and the hollow interior space of said portion of said intermediate region of said grab bar means through said opening into the interior of said sleeve to be received therefrom by the hollow interior space of said shower head means.

2. The combination of claim 1 and wherein said shower head means has an elongated tubular end region formed with said hollow interior space of said shower head means and fluid-tightly connected with said sleeve to communicate with the space between the latter and said portion of said intermediate region of said grab bar means.

3. The combination of claim 2 and wherein said opposed ends of said sleeve have at said fluid-tight engagement with said intermediate region of said grab bare means a sliding fit with respect to said intermediate region of said grab bar means and said sleeve having a length which is substantially less than the length of said intermediate region of said grab bar means so that said sleeve can be shifted together with said shower head means along said intermediate region of said grab bar means for adjusting the location of said shower head means, said sleeve having a length at least equal approximately to 1/2 the length of said intermediate region of said grab bar means and said opening being situated at least approximately midway between said end regions of said grab bar means so that at all possible positions of said sleeve on said intermediate region of said grab bar means said opening communicates with the interior of said sleeve.

4. The combination of claim 3 and wherein a guide means is situated between an operatively connected to said sleeve and intermediate region of said grab bar means for guiding said sleeve for longitudinal movement along said intermediate region while restraining said sleeve from turning around said intermediate region of said grab bar means.

5. The combination of claim 4 and wherein said intermediate region of said grab bar means has an outer surface portion and said sleeve has an inner surface portion directed toward said outer surface portion, and said guide means being carried by the latter surface portions and including a keyway member fixed to one of said surface portions and formed with a groove and a key member fixed to the other surface portions and received in said groove.

6. The combination of claim 5 and wherein said opposed ends of said sleeve are removably fixed to the remainder of said sleeve, and said sleeve having an inner diameter which is larger than the diameter of said intermediate region of said grab bar means to an extent sufficient to displace said key member out of said groove of said key-way member when said ends of said sleeve are separated therefrom, and said intermediate region of said grab bar means including a pair of sections respectively connected to said end regions of said grab bar means and removably connected to each other at a location within said sleeve, so that after said ends of said sleeve are separated therefrom and said sections of said grab bar means are separated from each other said sleeve can be removed from said grab bar means.

7. The combination of claim 6 and wherein one of said sections of said intermediate region of said grab bar means has an exteriorly threaded end region while the other has an interiorly threaded end region to receive said exteriorly threaded end region for providing said removable connection.

8. The combination of claim 7 and wherein said other section of said intermediate region of said grab bar means is connected with said one end region thereof and said other section and one end region forming a single continuous tubular member having said hollow interior spaces of said one end region and intermediate region of said grab bar means which communicates with each other.

9. The combination of claim 8 and wherein said opening is formed in a wall of said one section adjacent said interiorly threaded portion thereof.

* * * * *